US006970666B2

(12) United States Patent
Takahashi et al.

(10) Patent No.: US 6,970,666 B2
(45) Date of Patent: Nov. 29, 2005

(54) IMAGE FORMING APPARATUS

(75) Inventors: Masashi Takahashi, Yokohama (JP); Takeshi Watanabe, Ichikawa (JP); Minoru Yoshida, Machida (JP); Shoko Shimmura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 43 days.

(21) Appl. No.: 10/804,119

(22) Filed: Mar. 19, 2004

(65) Prior Publication Data

US 2005/0207779 A1 Sep. 22, 2005

(51) Int. Cl.[7] ..... G03G 15/16
(52) U.S. Cl. ..... 399/101; 399/99
(58) Field of Search ..... 399/99, 101

(56) References Cited

U.S. PATENT DOCUMENTS 5,995,780 A * 11/1999 Wayman ..... 399/93
6,201,940 B1 * 3/2001 Lee ..... 399/101
6,311,031 B1 * 10/2001 Hirano ..... 399/101
6,766,125 B1 * 7/2004 Izumi ..... 399/66
6,799,007 B2 * 9/2004 Suketomo ..... 399/99
6,879,801 B2 * 4/2005 Soda et al. ..... 399/302
2003/0215258 A1 * 11/2003 Suketomo ..... 399/99
2004/0213598 A1 * 10/2004 Mori et al. ..... 399/101
2005/0084282 A1 * 4/2005 Yamada et al. ..... 399/101

FOREIGN PATENT DOCUMENTS

JP 6-110343 A 4/1994
JP 2001-249549 A 9/2001
JP 2001-312154 A 11/2001
JP 2002-91191 A 3/2002

* cited by examiner

*Primary Examiner*—Christopher W. Fulton
*Assistant Examiner*—Yaritza Guadalupe
(74) *Attorney, Agent, or Firm*—Foley & Lardner LLP

(57) ABSTRACT

An image forming apparatus comprises an image carrier which retains an electrostatic latent image corresponding to an original image, a developing device which sticks a toner to the electrostatic latent image to develop a toner image on the image carrier, an intermediate transferrer to which the toner image on the image carrier is transferred, a secondary transfer roller which transfers the toner image on the intermediate transferrer onto paper, and a cleaning member which cleans the secondary transfer roller. The secondary transfer roller can move to a first position to contact the intermediate transferrer, and to a second position to be separated from the intermediate transferrer, and the secondary transfer roller contacts the cleaning member at the second position.

13 Claims, 6 Drawing Sheets

IMAGE FORMING APPARATUS

BACKGROUND OF THE INVENTION

The present invention relates to an electrophotographic image forming apparatus, and relates in particular to a configuration of a transfer device which transfers an image formed on an image carrier onto paper.

A transfer technique based on a corona charger facing a photosensitive drum is best known as a prior art of a transfer unit in an electrophotographic image forming apparatus. This method, however, has a problem of toxic ozone production. Thus, a contact type transfer technique is known as an ozoneless transfer technique.

Jpn. Pat. Appln. KOKAI Publication No. 6-110343 discloses a technique in which a transfer is performed by use of a semiconductive transfer belt, and a transfer roller provided on a back surface of the transfer belt. A transfer bias is applied to the transfer roller to achieve the transfer.

The following methods are known in connection with a color image forming apparatus which forms an image with a plurality of toners including Y (yellow), M (magenta), C (cyan) and Bk (black).

(1) A method in which the toners of four colors are superposed on one photosensitive drum to form an image, and the image is batch-transferred.

(2) A transfer drum method in which a transfer material is held on a transfer drum, and images of four colors are formed by four revolutions of the transfer drum.

(3) An intermediate transferrer method in which images of four colors are formed on an intermediate transferrer, and the image is batch-transferred to a transfer material.

(4) A four-drum method in which four photosensitive drums are disposed in parallel, and an image in four colors is formed while the transfer material passes one time.

Among the four methods described above, the intermediate transfer method (3) includes: (a) four revolution method in which one image carrier forms an image of each color, and repeatedly transfers the images onto the intermediate transferrer four times, and finally batch-transfers them on paper or the like; and (b) a four tandem method in which toner images of four colors are formed on an intermediate transfer belt at one time, and are finally batch-transferred on paper or the like.

In some of the intermediate transfer methods, a secondary transfer roller (transfer to the intermediate transferrer is a primary transfer) is used for a part where the final transfer is performed in the transfer material.

In the intermediate transfer method described above, a "fog" toner on the photosensitive drum sometimes sticks to the secondary transfer roller via the intermediate transferrer, in the image forming apparatus using the secondary transfer roller. Also, when the paper is not conveyed to a secondary transfer unit due to a problem in paper conveyance, the toner image on the intermediate transferrer sticks onto the secondary transfer roller. In such a case, there is a problem that the secondary transfer roller is smeared with the toner. The smeared secondary transfer roller leads to another problem that a rear side of the paper output at the next printing is smeared with the toner.

A technique is known in which a cleaner is attached to the secondary transfer roller, in order to solve the problem. Jpn. Pat. Appln. KOKAI Publication No. 2001-312154 discloses a configuration in which a secondary transfer member and a brush cleaning member are integrally brought in or out of contact.

Jpn. Pat. Appln. KOKAI Publication No. 2002-91191 discloses a technique for a configuration that satisfies $5\times10^3 \leqq (R1/R2)\times(V2/V1)\times D \leqq 6\times10^5$ where R1 (mm) is an exterior angle of the secondary transfer roller, V1 (mm/sec) is a peripheral velocity thereof, R2 (mm) is an external diameter of a brush roller, V2 (mm/sec) is a peripheral velocity thereof, and D (number/inch$^2$) is a hair transplant density.

However, in the configuration where the secondary transfer roller and the cleaning brush contact each other and rotate at an equal velocity and direction at the contact point, there is a problem of additional smearing due to a smear on the brush sticking again to the secondary transfer member.

BRIEF SUMMARY OF THE INVENTION

An object of the present invention is to provide an image forming apparatus which prevents a secondary transfer roller from being smeared so as not to smear a rear side of paper with a toner.

In order to achieve the above object, according to one aspect of the present invention, there is provided an image forming apparatus comprising: an image carrier which retains an electrostatic latent image corresponding to an original image; a developing device which sticks a toner to the electrostatic latent image to develop a toner image on the image carrier; an intermediate transferrer to which the toner image on the image carrier is transferred; a secondary transfer roller which transfers the toner image on the intermediate transferrer onto paper; and a cleaning member which cleans the secondary transfer roller; wherein the secondary transfer roller can move to a first position to contact the intermediate transferrer, and to a second position to be separated from the intermediate transferrer, and the secondary transfer roller contacts the cleaning member at the second position.

DETAILED DESCRIPTION OF THE INVENTION

Embodiments of the present invention will hereinafter be described with reference to the drawings.

Figure 1:
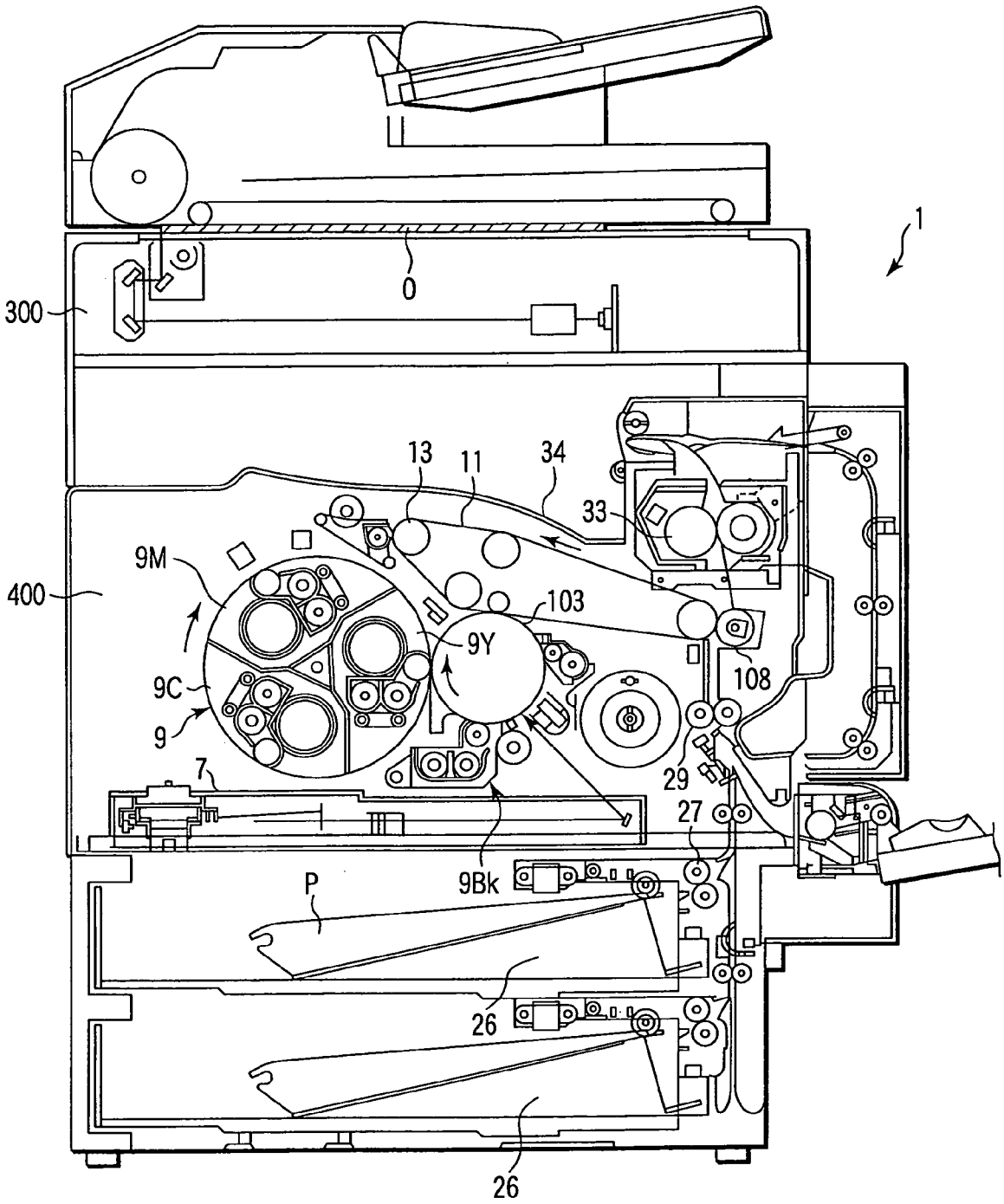
FIG. 1 is a sectional view showing an example of a color image forming apparatus having a four-revolution type image carrier to which a first embodiment of the present invention is applied.

FIG. 1 is a sectional view showing a color image forming apparatus 1 having a four-revolution type image carrier to which the present invention is applied. In FIG. 1, the image forming apparatus 1 has a photosensitive drum 3 which is the image carrier, and a color developer image is formed by four revolutions of the photosensitive drum.

Figure 2:
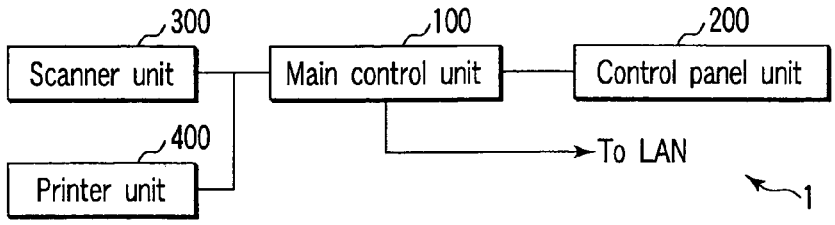
FIG. 2 is a block diagram representing a schematic configuration of the color image forming apparatus to which the first embodiment of the present invention is applied.

FIG. 2 is a block diagram representing a schematic configuration of a control system of the color image forming apparatus 1. The image forming apparatus 1 comprises a scanner unit 300 which reads an original image and provides an image data corresponding to the original image, a printer unit 400 which forms an image on paper on the basis of the image data from the scanner unit 300; a control panel unit 200 serving as a user interface; and a main control unit 100 which generally controls parts of a digital copier 10 on the basis of a user instruction input through the control panel unit 200.

The main control unit 100 can print out, on the printer unit 400, image data of an original read by the scanner unit 300. The main control unit 100 can also receive document data from an external device such as a personal computer via a network such as LAN, and print it out on the printer unit 400.

Figure 3:
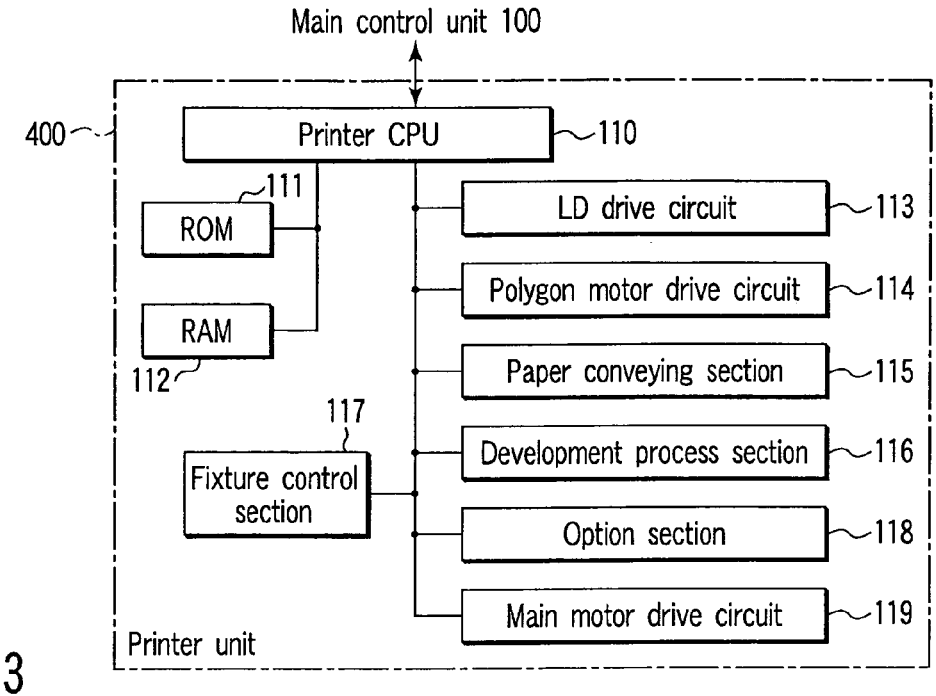
FIG. 3 is a block diagram showing a configuration of a printer unit.

FIG. 3 is a block diagram showing a configuration of the printer unit 400.

A printer CPU 110 generally controls the operation of the printer unit 400 in accordance with an operation instruction from a CPU 91. A ROM 111 stores a control program or the like including the present invention, and a RAM 112 is used to temporarily store data. An LD drive circuit 113 controls the turning on/off of a light emitted by a semiconductor laser, and a polygon motor drive circuit 114 controls rotation of a polygon motor that rotates a polygon mirror.

A paper conveying section 115 controls conveyance of paper through a conveying path, and a development process section 116 controls charging, developing and transfer processes of the photosensitive drum. A fixture control section 117 controls a fixer that fixes a toner image to the paper, and a main motor drive circuit 119 controls rotation of a main motor which rotates the photosensitive drum, a developing roller within a developing device, and the like.

Figure 4:
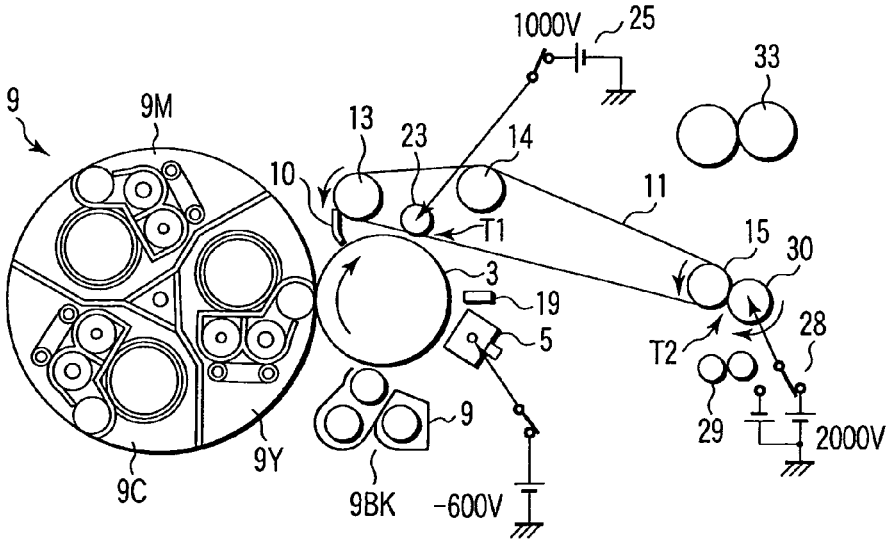
FIG. 4 is an enlarged detail view of an image forming process section.

FIG. 4 is an enlarged view showing a configuration of the development process section 116. Details of an image forming process will be described below by use of FIG. 1 to FIG. 4.

The photosensitive drum 3 is cylindrical and has a diameter of, for example, 100 mm, and is provided rotatably in a direction indicated by an arrow. The following is disposed around a periphery of the photosensitive drum 3 in a rotating direction. First, a charger 5 is provided opposite to a surface of the photosensitive drum 3. This charger 5 negatively (−) charges the photosensitive drum 3 uniformly. Instead of the non-contact type charger 5, a conductive roller, brush, blade or the like can also achieve non-contact type charging.

An exposure device 7 (see FIG. 1) which exposes the charged photosensitive drum 3 to form an electrostatic latent image is provided downstream of the charger 5 in a rotation direction of the photosensitive drum. Downstream of the exposure device 7, a developing device 9Bk is provided which accommodates a black (Bk) developer, and inversely develops the electrostatic latent image formed with this developer by the exposure device 7. Downstream of the developing device 9Bk, color developing devices 9Y, 9M and 9C accommodating yellow, magenta and cyan toners are provided, and these color developing devices are configured in such a manner that each of them rotates to contact the photosensitive drum 3.

A intermediate transfer belt 11, which primarily transfers a color toner image formed on the photosensitive drum and retains a color image, is installed downstream of the developing devices. If the photosensitive drum makes four revolutions and the color image is formed on the intermediate transfer belt, a developer image formed on the intermediate transfer belt is batch-transferred to conveyed paper at a secondary transfer position T2.

A discharge lamp 19 is provided downstream of a contact position T1 where the photosensitive drum 3 contacts the intermediate transfer belt 11. The discharge lamp 19 discharges electric charges on the surface of the photosensitive drum 3 with uniform light irradiation. The discharge by the discharge lamp 19 completes one cycle of image formation, and in the next image forming process, the charger 5 again uniformly charges the uncharged photosensitive drum 3.

The above process is repeated four times, thereby forming the color toner images of the colors yellow, magenta, cyan and black on the intermediate transfer belt. This intermediate transfer belt 11 has a seamless belt shape, and is supported on a driving roller 15 and a driven roller 13, which roll the intermediate transfer belt at a predetermined speed, and a tension roller 14 which tensions the belt. The driving roller 15 and the driven roller 13 are provided rotatably in directions indicated by arrows.

On the intermediate transfer belt 11, a cleaning device 10 which can be in or out of contact is additionally disposed. The cleaning device 10 is a rubber blade or a brush, for example. While the color image is being primary-transferred onto the intermediate transfer belt, the cleaning device 10 is out of contact with the belt. After the color image is secondary-transferred to the paper, the cleaning device 10 contacts the belt 11 in order to clean the surface of the belt.

The intermediate transfer belt 11 is formed of polyimide having a thickness of 100 $\mu$m in which carbon is uniformly dispersed. This conveying belt has an electric resistance of, for example, $10^{10}$ Ω cm, and is semiconductive.

A material for the intermediate transfer belt may be a semiconductive material having a volume resistance value of $10^{8}$ to $10^{13}$ Ω cm. In addition to polyimide in which carbon is dispersed, it may be, for example, polyethylene terephthalate, polycarbonate, polytetrafluoro-ethylene, polyvinylidene fluoride or the like in which conductive particles such as carbon are dispersed. Instead of conductive particles, a polymer film in which electric resistance is adjusted by composition adjustment may be used. Moreover, it may be such a polymer film into which ion conductive substances are mixed, or a rubber material such as silicon rubber or urethane rubber having a relatively low electric resistance.

A secondary transfer roller 30 is disposed opposite to the driving roller 15. The secondary transfer roller can be operated to be in or out of contact with the intermediate transfer belt, and is out of contact when the color image is primary-transferred onto the intermediate transfer belt. After the color images of four colors are formed on the intermediate transfer belt, the secondary transfer roller 30 contacts the intermediate transfer belt 11 at the secondary transfer position T2, and secondary-transfers the color image in a batch manner onto conveyed paper P.

In the vicinity of the contact position T1 where the intermediate transfer belt 11 contacts the photosensitive drum 3, a transfer device 23 as a primary transfer means is provided opposite to the photosensitive drum. The transfer device 23 ensures that the intermediate transfer belt 11 contacts the photosensitive drum 3.

The transfer device 23 is comprised of a urethane foam roller which is made conductive by dispersing carbon, and a metal core bar to which a positive (+) constant voltage direct-current power supply is connected.

On the other hand, a paper feed cassette 26 which stores the paper P is provided under the image forming apparatus 1, as shown in FIG. 1. In a main body of the image forming apparatus, a pickup roller 27 is provided which picks up the paper P one by one from the paper feed cassette 26. A resist roller pair 29 is rotatably provided between the pickup roller 27 and the intermediate transfer belt 11. The resist roller pair 29 supplies, with predetermined timing, the paper P to the secondary transfer position T2 where the intermediate transfer belt is opposite to the secondary transfer roller. Above the secondary transfer position T2, there are provided a fixer 33 which fixes the developer onto the paper P, and a discharge tray 34 where the paper P on which the developer has been fixed by the fixer is discharged.

Next, a color image forming process of the image forming apparatus having the above-described configuration will be described.

When a user gives an instruction for starting image formation via the control panel unit 200 disposed on a front side of the image forming apparatus, the photosensitive drum 3 starts rotating by receiving a driving force from an unshown drive mechanism. The charger 5 charges the photosensitive drum 3 uniformly at about −600 V.

The exposure device 7 applies a light corresponding to an image to be recorded to the photosensitive drum 3 uniformly charged by the charger 5, and forms an electrostatic latent image on the photosensitive drum 3. The developing device 9Y develops the electrostatic latent image with the developer, and forms a yellow developer image.

When a yellow toner image formed on the photosensitive drum 3 reaches the contact position T1 where the intermediate transfer belt 11 and the transfer member 23 contact the photosensitive drum 3, a bias voltage of about +1000 V is applied to the transfer member 23. A transfer electric field is formed between the transfer member 23 and the photosensitive drum 3, and the yellow developer image on the photosensitive drum 3 is transferred onto the intermediate transfer belt 11 in accordance with this transfer electric field. In other words, the image is transferred onto the intermediate transfer belt at the contact position T1 where it contacts the intermediate transfer belt. The toner remaining on the photosensitive drum after the primary transfer is cleaned by the cleaning device, and is again charged by the charger 5.

Next, the exposure device forms an electrostatic latent image corresponding to a magenta image on the photosensitive drum. The developing device 9 rotates by a predetermined angle of rotation, and the magenta developing roller of the developing device 9M rotates in a state opposite to the photosensitive drum 3, and then a magenta toner is developed. Further, a magenta toner image is transferred onto the intermediate transfer belt 11 at the contact position T1. In the same manner, a cyan toner image is formed. In addition, a black toner image is formed by a developing device 9B.

When the color toner images of four colors are formed on the intermediate transfer belt 11, the paper P is supplied to the transfer area T2 at the right moment when the toner image arrives at the transfer position T2 where the intermediate transfer belt is opposite to the secondary transfer roller. At this moment, the secondary transfer roller 30 contacts the intermediate transfer belt and a direct current bias of about +2000 V is applied to the secondary transfer roller 30. The toner image is transferred onto the paper P owing to the transfer electric field formed by the bias.

The developer images thus batch-transferred are fixed onto the paper P by the fixer 33. The paper P on which the developer images have been transferred is discharged onto the discharge tray 34. The secondary transfer roller is out of contact with the intermediate transfer belt 11 after the transfer. The toner remaining on the intermediate transfer belt 11 is cleaned by the cleaning device 10.

Next, the cleaning device of the secondary transfer roller according to the embodiment of the present invention applied to the image forming apparatus described above will be described in detail.

In the embodiment indicated below, the present invention will be described with an example of a type of image forming apparatus in which the intermediate transfer belt makes four revolutions to form a color image, as shown in FIG. 1 and the like. In addition, also in the case of a four tandem type, a part where the secondary transfer roller 30, the intermediate transfer belt 11 and the driving roller 15 contact is the secondary transfer position T2, thus the following embodiment is achieved in the same manner. Therefore, an embodiment of the four tandem type image forming apparatus will not be described.

Figure 5:
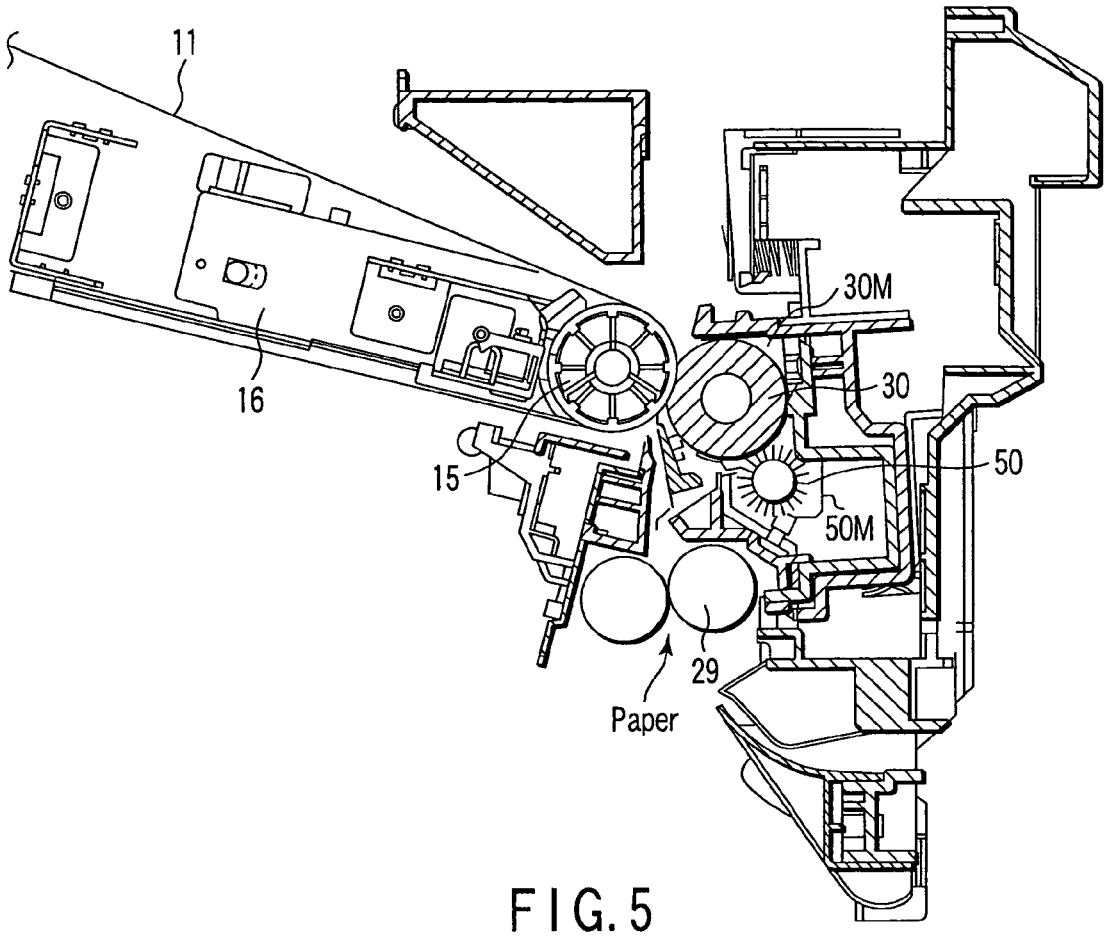
FIG. 5 is an enlarged schematic diagram of a secondary transfer unit of the image forming apparatus as shown in FIG. 1.

FIG. 5 is an enlarged schematic diagram of a secondary transfer unit of the image forming apparatus shown in FIG. 1 and the like.

Figure 6:
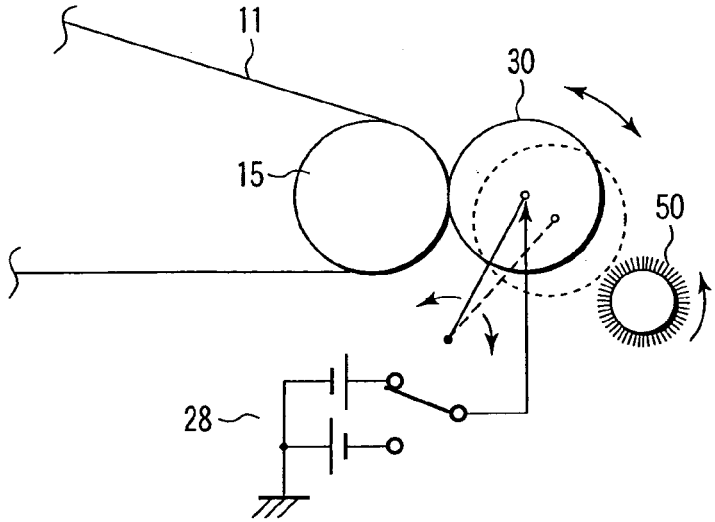
FIG. 6 shows a schematic configuration of the first embodiment of the present invention.

FIG. 6 shows a schematic configuration of a first embodiment of the present invention.

The secondary transfer roller 30 has a mechanism whereby the secondary transfer roller 30 is in or out of contact with the intermediate transfer belt 11 by use of a cam or the like. This is characterized by a configuration in which when the secondary transfer roller 30 is out of contact with the intermediate transfer belt 11, the secondary transfer roller 30 contacts a cleaning brush 50. The cleaning brush 50 is, for example, a rotating roller type brush of $\phi$ 17 mm. The secondary transfer roller 30 contacts the intermediate transfer belt via the paper only when transferring the toner image on the intermediate transfer belt onto the paper, and at other times, the secondary transfer roller 30 is positioned to be out of contact and is basically hardly smeared.

Figure 7:
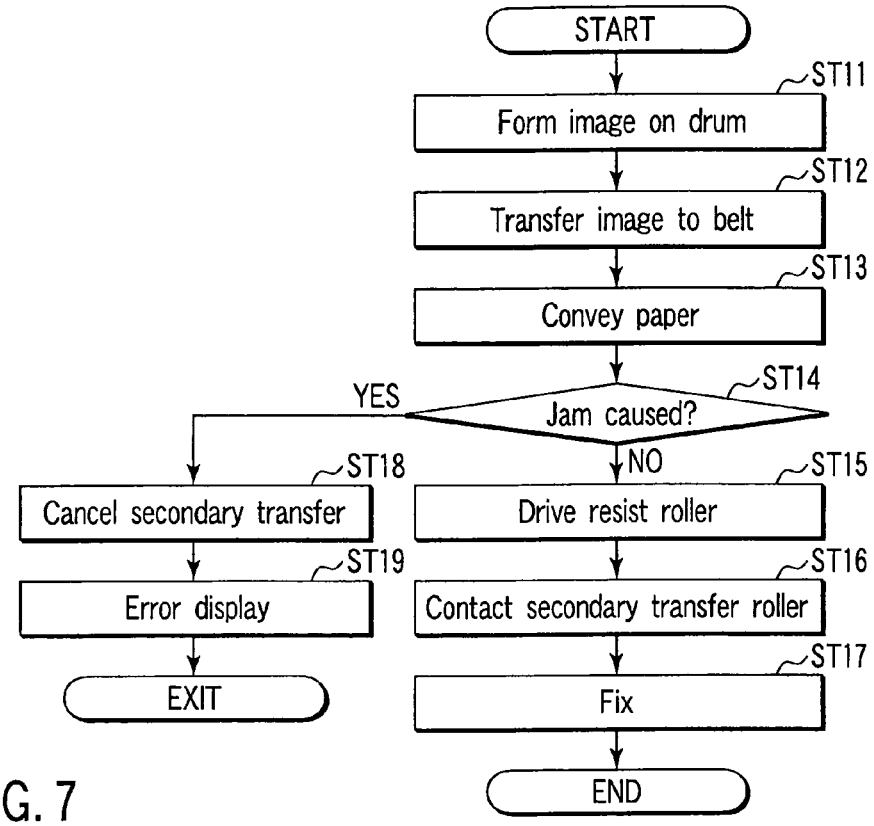
FIG. 7 is a flowchart showing an overview of printing operation.

When a problem is caused in paper conveyance and paper is not conveyed as usual in the secondary transfer (when a so-called jam is caused), the toner image is transferred to the secondary transfer roller, and the secondary transfer roller is smeared in some cases. FIG. 7 is a flowchart showing an overview of printing operation. A color image is formed on the photosensitive drum in step ST11. More specifically, an electrostatic latent image is formed on the photosensitive drum 3 by a laser beam emitted from the exposure device 7 as described above, and the electrostatic latent image is developed into a toner image by the developing device 9. The toner image is transferred to the intermediate transfer belt 11 (ST12). The paper is conveyed from the paper feed cassette 26 to the resist roller pair 29 (ST13), and if the jam is not caused in the meantime (NO in ST14), the paper is fed from the resist roller pair 29 to the secondary transfer position T2 (ST15). When the paper reaches the secondary transfer position T2, the secondary transfer roller 30 contacts the intermediate transfer belt 11, and the toner image is transferred to the paper (ST16). Subsequently, the toner image is fixed onto the paper by the fixer 33.

In addition, the jam occurred as in the step ST14 is always detected while the paper is conveyed and fed. If the jam is caused (YES in ST14), the driving of the intermediate transfer belt 11 and the secondary transfer roller 30 is stopped (ST18), and an error message indicating that a paper jam exists is displayed on a control panel (ST19). Subsequently, a "jam handling sequence" is executed.

Figure 8:
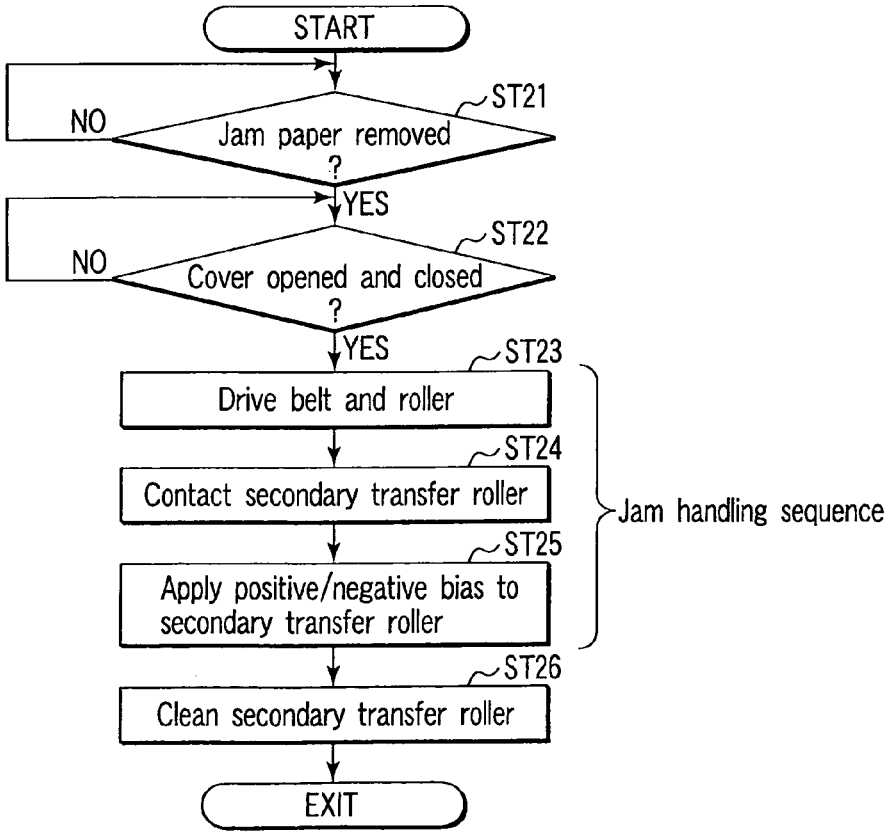
FIG. 8 is a flowchart showing a jam handling sequence.

FIG. 8 is a flowchart showing the jam handling sequence.

First, it is checked that the jammed paper is removed from the paper conveying path (ST21), and it is ascertained that a cover for removing the jam paper is changed from "open" to "closed" (ST22). Next, the intermediate transfer belt 11 and the secondary transfer roller 30 are driven (ST23), and the secondary transfer roller 30 is brought in contact with the intermediate transfer belt 11 (ST24), and then a positive (+)/negative (−) bias voltage (e.g., ±2000 V) is repeatedly applied to the secondary transfer roller 30 by an application section 28 for several times (ST25). As the toner sticking to the secondary transfer roller 30 is charged positively or negatively, by repeatedly applying the positive/negative bias voltage as in step ST25, the toner on the secondary transfer roller is discharged to an intermediate transfer belt side. At this moment, the secondary transfer roller is rotated about ten times, and the ordinary polarity of a secondary transfer bias is switched upon every revolution of the secondary transfer roller, thus applying the bias voltage thereof to the secondary transfer roller. These steps ST23 to ST25 comprise the jam handling sequence.

Subsequently, when the secondary transfer roller 30 is separated from the intermediate transfer belt 11, the secondary transfer roller contacts the cleaning brush 50, and the toner which could not be returned to a belt side by the application of bias voltage in the jam handling sequence is cleaned by the cleaning brush 50 (ST26). At this moment, the secondary transfer roller 30 and the cleaning brush 50 are respectively driven by driving sections 30M and 50M (see FIG. 5) so that their peripheral velocities will be different (so that they will be in friction at a contact position T3).

In the present embodiment, the cleaning brush 50 is not smeared to a high degree, but a scratching member may be disposed in the brush 50 to more positively scratch off the toner sticking to the brush. The scratching member is, for example, a plate-shaped member, and is disposed to cut into the brush at about 1 mm.

Figure 9:
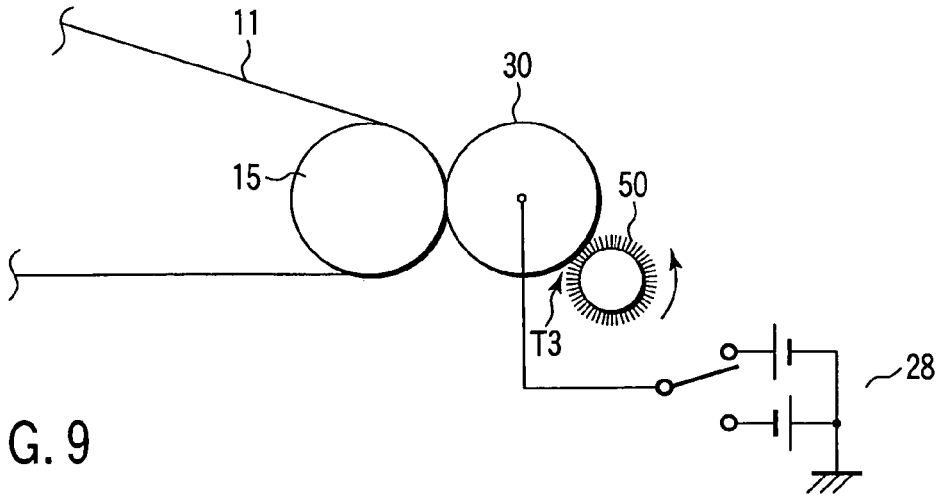
FIG. 9 shows a schematic configuration of a second embodiment of the present invention.

FIG. 9 shows a schematic configuration of a second embodiment of the present invention.

A constant positional relationship is always kept between the secondary transfer roller 30 and the cleaning brush 50, and the roller 30 is not in a contacting/separating relationship with the brush 50. In other words, the secondary transfer roller 30 is in or out of contact with the intermediate transfer belt 11, and the secondary transfer roller 30 and the cleaning brush 50 operate integrally.

The secondary transfer roller 30 and the cleaning brush 50 are respectively driven by the driving sections 30M and 50M so that a relative peripheral velocity will be 0 (their peripheral velocities and direction thereof will be the same at the contact position T3) in an ordinary operation, and the roller 30 and the brush 50 do not slip on each other. Therefore, the brush 50 has a minimized effect of scratching the smear on the secondary transfer roller.

When the jam is caused and the secondary transfer roller 30 is smeared, the jam handling sequence is performed to return the toner on the secondary transfer roller 30 to the side of the intermediate transfer belt 11. Subsequently, the rotation speed of the secondary transfer roller 30 or the cleaning brush 50 is changed so that their peripheral velocities will be different (so that they will be in friction at the contact position T3). This enhances the cleaning performance of the brush 50, and the surface of the roller is cleaned. The peripheral velocities at the contact position T3 may have a difference of about 30%. In this case, the rotation speed of either the roller 30 or the brush 50 may be changed.

The second embodiment may be used in combination with the first embodiment described above, but the effect is obtained with only one embodiment.

Figure 10:
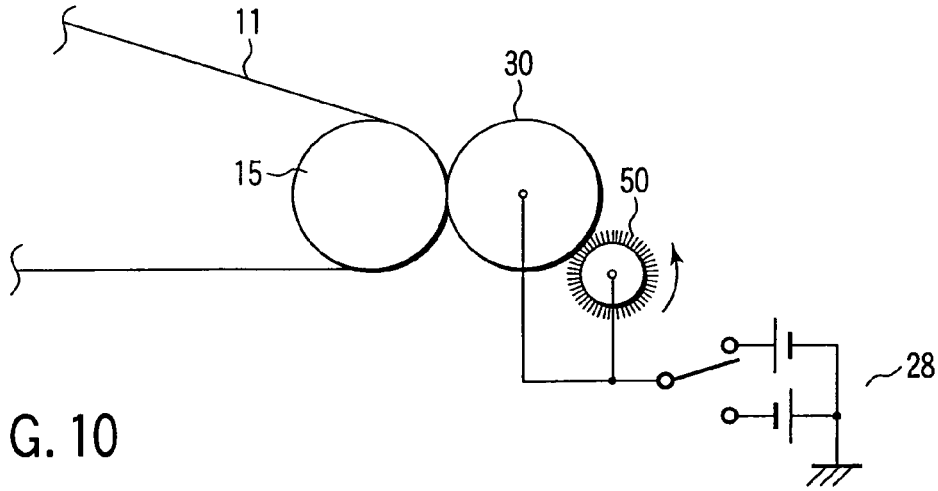
FIG. 10 shows a schematic configuration of a third embodiment of the present invention.

FIG. 10 shows a schematic configuration of a third embodiment of the present invention.

In the present embodiment, the same bias voltage is applied to the cleaning brush 50 and the secondary transfer roller 30. In other words, the same potential is always applied to the secondary transfer roller 30 and the cleaning brush 50 so that the electric field is not produced therebetween. This makes it possible to prevent the extra toner from entering into the brush 50.

When the jam handling sequence is performed, a positive/negative bias voltage is alternately applied to the brush 50 similarly to the secondary transfer roller 30. In this case, it is preferable that the brush fiber is conductive, and its electric resistance is within a range of $10^5$ Ω to $10^8$ Ω. For example, it can be produced from fiber in which carbon is dispersed in nylon or acrylic.

The third embodiment may also be used in combination with the embodiments described above, but the effect is obtained as one embodiment.

Figure 11:
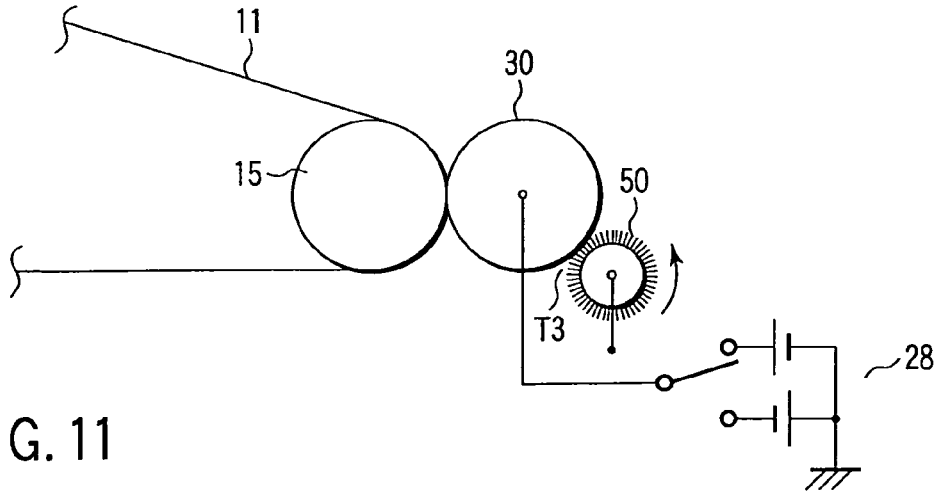
FIG. 11 shows a schematic configuration of a fourth embodiment of the present invention.

FIG. 11 shows a schematic configuration of a fourth embodiment of the present invention.

In the configuration of the fourth embodiment, the cleaning brush 50 is in an electrically floating state, and a specific electric field is not produced between the secondary transfer roller 30 and the cleaning brush 50. In this way, also during cleaning processing in accordance with the jam handling sequence, the entrance of the toner to the brush side is restricted to the minimum, and most of the toner is discharged to the belt side. In this case, the brush is desirably made of an insulating material.

Figure 12:
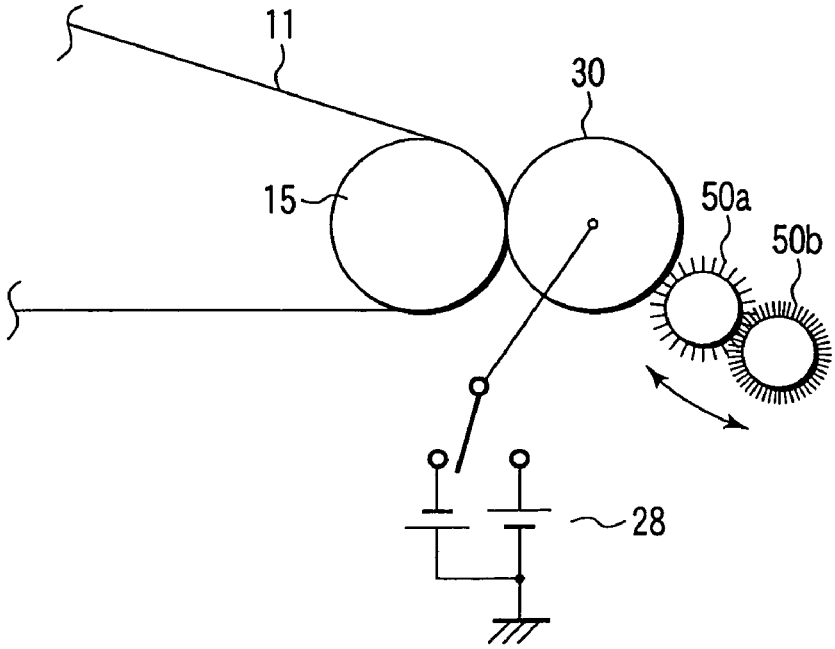
FIG. 12 shows a schematic configuration of a fifth embodiment of the present invention.

FIG. 12 shows a schematic configuration of a fifth embodiment of the present invention.

The configuration of the fifth embodiment has a first cleaning brush 50*a* for cleaning the secondary transfer roller, and a second cleaning brush (auxiliary brush) 50*b* which cleans the brush 50*a*. The first cleaning brush 50*a* to be used has a lower fiber density (number per unit area) and shorter fiber than the second cleaning brush 50*b*. Thus, the toner brought in by first brush 50*a* is scratched off by the second brush 50*b*.

The first and second cleaning brushes are configured to satisfy $L1 \leqq 1.5 \times L2$, where L1 (mm) is the fiber length of the first cleaning brush 50*a*, and L2 (mm) is the fiber length of the second cleaning brush 50*b*. The brushes are configured to satisfy $D1 \leqq 2 \times D2$, where D1 (number/inch$^2$) is the fiber density of the first cleaning brush 50*a*, and D2 (number/inch$^2$) is the fiber density of the second cleaning brush 50*b*. For example, it is possible to use the first brush having a density of 2000/inch$^2$ and a length of 3 mm, and the second brush having a density of 5000/inch$^2$ and a length of 5 mm.

It is preferable that the second cleaning brush 50*b* to be used has a higher fiber hardness than the first cleaning brush 50*a*. The first and second cleaning brushes are configured to satisfy $Y1 \leqq 1.5 \times Y2$, where Y1 (N/mm$^2$) is the Young's modulus of the fiber used for the first cleaning brush 50*a*, and Y2 (N/mm$^2$) is the Young's modulus of the fiber used for the second cleaning brush. For example, it will be more effective if the fibers of a nylon brush have a Young's modulus of 1500 to 2000 N/mm$^2$ are used as the first cleaning brush, and an acrylic fiber brush having a Young's modulus of 3000 to 3700 N/mm$^2$ is used as the second cleaning brush.

Alternatively, the first and second cleaning brushes are configured so that the first cleaning brush 50*a* has a smaller fiber thickness than the second cleaning brush 50*b*. For example, the thickness of the fiber used for the first cleaning brush can be 2 deniers, and the thickness of the fiber used for the second brush can be 6 deniers.

Figure 13:
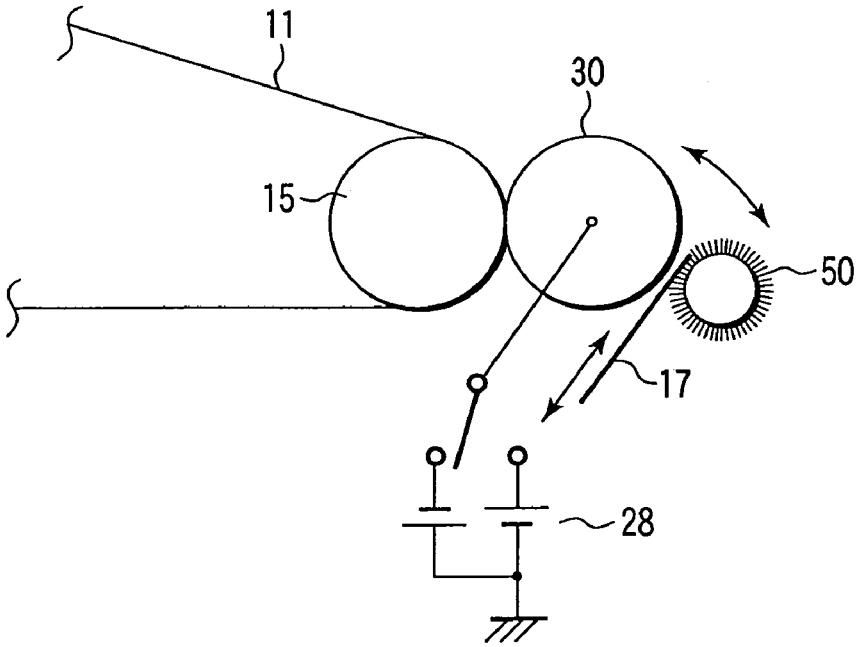
FIG. 13 shows a schematic configuration of a sixth embodiment of the present invention.

FIG. 13 shows a schematic configuration of a sixth embodiment of the present invention.

In the sixth embodiment, a shutter 17 which is a plate-shaped member and can be moved is provided between the secondary transfer roller 30 and the brush 50. In an ordinary operation, the shutter 17 does not contact the secondary transfer roller 30 and is disposed (closed) so as to firmly hold the cleaning brush 50. After the jam handling sequence, the shutter 17 is opened to bring the brush 50 in contact with the roller 30, thereby cleaning the roller 30. After the cleaning, the shutter 17 is closed again so that the brush 50 does not contact the secondary transfer roller 30.

As described above, according to the present invention, it is possible to provide a satisfactory image without a smear on the rear side of the paper due to the smear on the secondary transfer roller, in the color image forming apparatus including the four revolution type and four tandem type color image forming apparatus.

The above description represents embodiments of this invention and does not limit the apparatus and method of this invention, and various modifications can be made. Such modifications also fall within the present invention. For instance, the belt is used as the intermediate transferrer in the present embodiments, but a drum-shaped member or the like may be used instead of the belt. Further, the brush is used as the cleaning member to clean the secondary transfer roller in the present embodiments, but a foam elastic roller or a metallic roller may be used. Moreover, the apparatus and method configured with a proper combination of components, functions, and features or method steps in the embodiments also fall within the present invention.

What is claimed is:

1. An image forming apparatus comprising:

an image carrier which retains an electrostatic latent image corresponding to an original image;

a developing device which sticks a toner to the electrostatic latent image to develop a toner image on the image carrier;

an intermediate transferrer to which the toner image on the image carrier is transferred;

a secondary transfer roller which transfers the toner image on the intermediate transferrer onto paper; and a cleaning member which cleans the secondary transfer roller;

wherein the secondary transfer roller can move to a first position to contact the intermediate transferrer, and to a second position to be separated from the intermediate transferrer, and the secondary transfer roller contacts the cleaning member when being located at the second position.

2. An image forming apparatus comprising:

an image carrier which retains an electrostatic latent image corresponding to an original image;

a developing device which sticks a toner to the electrostatic latent image to develop a toner image on the image carrier;

an intermediate transferrer which transfers the toner image on the image carrier;

a secondary transfer roller which transfers the toner image on the intermediate transferrer onto paper;

a cleaning member which cleans the secondary transfer roller;

an application section which, when a jam is caused in conveyance of the paper, repeatedly applies positive and negative bias voltages to the secondary transfer roller after the paper is removed, and moves the toner on the secondary transfer roller to the intermediate transferrer; and a rotational driving section which rotationally drives the secondary transfer roller and the cleaning member so that their peripheral velocities and direction thereof will be the same at a contact position where the secondary transfer roller contacts the cleaning member in an ordinary operation, and that the peripheral velocities will be different when the jam is caused.

3. The image forming apparatus according to claim 2, wherein the application section applies the same potential to the cleaning member and the secondary transfer roller.

4. The image forming apparatus according to claim 3, wherein the cleaning member includes a brush, and a material of the brush is conductive fiber having an electric resistance ranging from $10^5$ Ω to $10^8$ Ω.

5. The image forming apparatus according to claim 2, wherein the cleaning member is configured to be in an electrically floating state.

6. The image forming apparatus according to claim 5, wherein the cleaning member includes a brush, and a material of the brush comprises conductive fiber.

7. The image forming apparatus according to claim 2, having an auxiliary member which cleans the cleaning member.

8. The image forming apparatus according to claim 7, wherein the cleaning member and the auxiliary member include brushes, and $L1 \leqq 1.5 \times L2$ is satisfied, where L1 (mm) is a fiber length of the cleaning member, and L2 (mm) is a fiber length of the auxiliary member.

9. The image forming apparatus according to claim 7, wherein the cleaning member and the auxiliary member include brushes, and $D1 \leqq 2 \times D2$ is satisfied, where D1 (number/inch$^2$) is a fiber density of the cleaning member, and D2 (number/inch$^2$) is a fiber density of the auxiliary member.

10. The image forming apparatus according to claim 7, wherein the cleaning member and the auxiliary member include brushes, and $Y1 \leqq 1.5 \times Y2$ is satisfied, where Y1 (N/mm$^2$) is Young's modulus of the fiber of the cleaning member, and Y2 (N/mm$^2$) is Young's modulus of the fiber of the auxiliary member.

11. The image forming apparatus according to claim 7, wherein the cleaning member and the auxiliary member include brushes, and the cleaning member has a smaller fiber thickness than that of the auxiliary member.

12. An image forming apparatus comprising:

an image carrier which retains an electrostatic latent image corresponding to an original image;

a developing device which sticks a toner to the electrostatic latent image to develop a toner image on the image carrier;

an intermediate transferrer which transfers the toner image on the image carrier;

a secondary transfer roller which transfers the toner image on the intermediate transferrer onto paper;

a cleaning member which cleans the secondary transfer roller;

a shutter member provided between the cleaning member and the secondary transfer roller;

an application section which, when a jam is caused in conveyance of the paper, repeatedly applies positive and negative bias voltages to the secondary transfer roller after the paper is removed, and moves the toner on the secondary transfer roller to the intermediate transferrer; and a rotational driving section which rotationally drives the secondary transfer roller and the cleaning member so that their peripheral velocities and direction thereof will be the same at a contact position where the secondary transfer roller contacts the cleaning member in an ordinary operation, and that the peripheral velocities will be different when the jam is caused.

13. The image forming apparatus according to claim 12, wherein the shutter member can be moved, and is disposed so that the secondary transfer roller is out of contact with the cleaning member in the ordinary operation, and after the application section has completed the voltage application to handle the jam caused, the shutter member is disposed so that the secondary transfer roller contacts the cleaning member, and the toner remaining on the secondary transfer roller is cleaned by the cleaning member.

* * * * *